US010690449B2

(12) United States Patent
Cosentino

(10) Patent No.: US 10,690,449 B2
(45) Date of Patent: Jun. 23, 2020

(54) KINEMATIC RAIL MOUNT FOR MOUNTING A DEVICE ON A FIREARM RAIL

(71) Applicant: Steiner eOptics, Inc., Waitsfield, VT (US)

(72) Inventor: Tim J. Cosentino, Waitsfield, VT (US)

(73) Assignee: Steiner eOptics, Inc., Waitsfield, VT (US)

( * ) Notice: Subject to any disclaimer, the term of this patent is extended or adjusted under 35 U.S.C. 154(b) by 0 days.

(21) Appl. No.: 15/984,945

(22) Filed: May 21, 2018

(65) Prior Publication Data

US 2018/0340754 A1 Nov. 29, 2018

Related U.S. Application Data

(60) Provisional application No. 62/510,124, filed on May 23, 2017.

(51) Int. Cl.
*F41G 11/00* (2006.01)

(52) U.S. Cl.
CPC ..... *F41G 11/003* (2013.01)

(58) Field of Classification Search
CPC ..... F41G 11/00; F41G 11/001; F41G 11/003; F41G 11/004; F41G 11/005
USPC ..... 42/124, 125, 126
See application file for complete search history.

(56) References Cited

U.S. PATENT DOCUMENTS 5,155,915 A * 10/1992 Repa ..... F41G 1/383 42/127
5,375,361 A * 12/1994 Rustick ..... F41G 11/003 42/125
7,562,485 B2 * 7/2009 Newhall ..... F41G 11/003 42/124
7,614,175 B2 * 11/2009 Davis ..... F41G 11/003 42/124
7,685,759 B2 3/2010 Teetzel
8,201,355 B2 * 6/2012 Couture ..... F41G 11/003 42/124

(Continued)

OTHER PUBLICATIONS

European Search Report, corresponding to EP18173583, dated Sep. 5, 2018, 1 page.

(Continued)

*Primary Examiner* — Derrick R Morgan
(74) *Attorney, Agent, or Firm* — Innovation Counsel LLP

(57) ABSTRACT

The present disclosure provides a rail mount for mounting a device on a rail. According to an embodiment, the mount comprises a frame having a length along a first direction, a width along a second direction, and a height along a third direction; a clamp operatively connected to the frame to be slidable along the second direction; an adjustment cam operatively connected to the frame to be rotatable around a first axis extending along the third direction; and a lever cam operatively connected to the adjustment cam to be rotatable around a second axis extending along the third direction. The lever cam is configured to translate a rotary force applied thereto into a linear force applied to the clamp along the second direction. The adjustment cam is configured to shift the second axis closer to or further from the frame along the second direction when the adjustment cam is rotated.

16 Claims, 16 Drawing Sheets

(56) References Cited

U.S. PATENT DOCUMENTS 8,393,105 B1 * 3/2013 Thummel ..... F41G 11/004 42/127
8,397,421 B2 * 3/2013 Ding ..... F41G 11/003 42/124
8,806,796 B1 * 8/2014 Clifton ..... F41G 11/003 42/127
8,931,161 B2 * 1/2015 Couture ..... F41G 11/003 29/464
9,395,158 B2 * 7/2016 Collin ..... F41G 11/003
9,568,281 B1 * 2/2017 Chen ..... F41A 23/10
9,581,416 B1 2/2017 Yim et al.
10,024,632 B1 * 7/2018 Oglesby ..... F41G 11/003
10,036,614 B1 * 7/2018 Ruiz ..... F41G 11/003
2008/0155876 A1 * 7/2008 Matthews ..... F41G 11/003 42/124
2008/0216380 A1 * 9/2008 Teetzel ..... F41G 11/003 42/127
2009/0000174 A1 * 1/2009 Davis ..... F41G 11/003 42/90
2009/0038201 A1 * 2/2009 Cheng ..... F41G 11/003 42/127
2010/0031553 A1 * 2/2010 Couture ..... F41G 11/003 42/90
2011/0146128 A1 * 6/2011 Haering ..... F41G 11/003 42/90
2011/0167701 A1 * 7/2011 Williams ..... F41C 23/16 42/90
2011/0247255 A1 * 10/2011 Ding ..... F41G 11/003 42/90
2011/0290968 A1 * 12/2011 Maughan ..... F41G 11/004 248/231.51
2013/0256484 A1 * 10/2013 Kessler ..... G03B 17/561 248/224.7
2013/0333184 A1 12/2013 Couture et al.
2014/0137457 A1 * 5/2014 Collin ..... F41G 11/003 42/90
2014/0196348 A1 * 7/2014 Samson ..... F41C 27/00 42/90
2014/0252187 A1 * 9/2014 Petrovic ..... F16B 2/185 248/229.16
2018/0259298 A1 * 9/2018 Gao ..... F41G 11/003
2018/0340754 A1 * 11/2018 Cosentino ..... F41G 11/003
2018/0340755 A1 * 11/2018 Cosentino ..... F41G 11/003

OTHER PUBLICATIONS

European Search Report, corresponding to EP18173573, dated Sep. 4, 2018, 1 page.

* cited by examiner

KINEMATIC RAIL MOUNT FOR MOUNTING A DEVICE ON A FIREARM RAIL

CROSS REFERENCE TO RELATED APPLICATIONS

This application claims benefit of priority to U.S. Provisional Patent Application No. 62/510,124 titled "A KINEMATIC RAIL MOUNT FOR MOUNTING A DEVICE ON A FIREARM RAIL" and filed May 23, 2017, which is incorporated herein by reference in its entirety.

RELATED FIELD

The present disclosure relates to a mount for mounting a device on a firearm rail.

BACKGROUND

Firearms have been around a long time, and their designs have evolved greatly and continue to evolve. One aspect of this evolution is that modern firearms have become more modular. For example, many modern firearms include an accessory rail on which various devices, such as a telescopic sight, a holographic sight, a laser sight, a flashlight, etc., may be mounted. While there are many existing mounts for mounting a device on an accessory rail, these existing mounts generally suffer from several drawbacks outlined below.

Typically, when a new sight is first mounted on a firearm, the point of aim of the sight would need to be adjusted to match the point of impact of the firearm. This process is generally known as "zeroing" the sight, which can be an arduous task for most shooters. However, because different sights offer different advantages, a shooter may want to swap out the sights after zeroing. Thus, it is desirable for the sight to maintain its point of aim, or "return to zero," despite repetitions of un-mounting and re-mounting the sight. Unfortunately, with many of the existing mounts, the point of aim of the mounted sight tends to shift between repetitions of un-mounting and re-mounting due to the over constrained clamping mechanism utilized by these mounts.

Furthermore, many of the existing mounts have either no adjustment mechanism for tuning its clamping force, use springs to compensate, or have tool actuated adjusters. A mount that does not offer clamping force adjustment may be mounted on too tightly or too loosely due to manufacturing variations in rail geometry. A mount that uses a spring to compensate for variations in rail geometry may produce soft clamping and thus may not be ideal for heavy payloads, since the mount would need a spring soft enough to be compressed by a hand-actuated lever but stiff enough to hold the mount in position under firearm recoil. A mount that requires a tool for tuning its clamping force would force the shooter to carry the correct tool for making field adjustments, thereby inconveniencing the shooter.

Embodiments of the present disclosure substantially overcome the above-discussed drawbacks of existing mounts for a mounting device on a firearm rail.

SUMMARY

The present disclosure provides a rail mount for mounting a device on a rail. According to an embodiment, the mount comprises a frame having a length along a first direction, a width along a second direction, and a height along a third direction; a clamp operatively connected to the frame to be slidable along the second direction to clamp the mount to the rail; an adjustment cam operatively connected to the frame to be rotatable around a first axis extending along the third direction; and a lever cam operatively connected to the adjustment cam to be rotatable around a second axis extending along the third direction, wherein the lever cam is configured to translate a rotary force applied thereto into a linear force applied to the clamp along the second direction, and wherein the adjustment cam is configured to shift the second axis closer to or further from the frame along the second direction when the adjustment cam is rotated around the first axis.

BRIEF DESCRIPTION OF THE DRAWINGS

The accompanying drawings, which are included as part of the present disclosure, illustrate various embodiments and together with the general description given above and the detailed description of the various embodiments given below serve to explain and teach the principles described herein.

Figure 1:
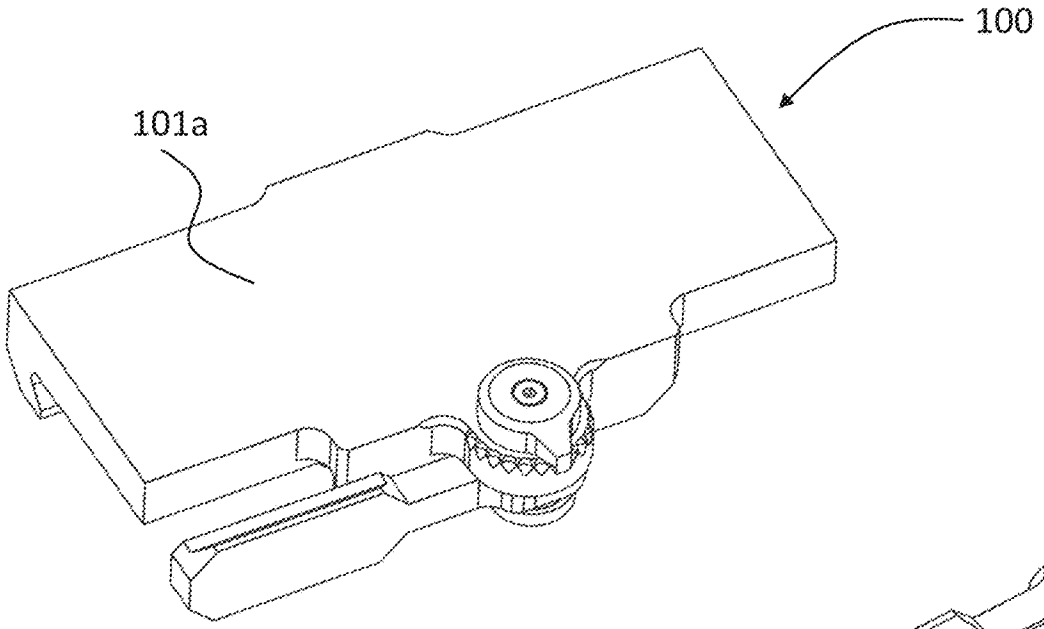
FIG. 1 is a top view of a kinematic rail mount for mounting a device on a firearm rail, according to an embodiment of the present disclosure.

The figures in the drawings are not necessarily drawn to scale and elements of similar structures or functions are generally represented by like reference numerals for illustrative purposes throughout the figures. The figures are only intended to facilitate the description of the various embodiments described herein and do not describe every aspect of the teachings disclosed herein and do not limit the scope of the claims.

DETAILED DESCRIPTION

Each of the features and teachings disclosed herein may be utilized separately or in conjunction with other features and teachings to provide the present system and method. Representative examples utilizing many of these features and teachings, both separately and in combination, are described with reference to the attached figures. While the detailed description herein illustrates to a person of ordinary skill in the art further details for practicing aspects of the present teachings, it does not limit the scope of the claims. Therefore, combinations of features disclosed in the detailed description are representative examples of the present teachings and may not be necessary to practice the teachings in the broadest sense.

Relative terms, such as "top," "bottom," "left," "right," etc., may be used herein to describe the spatial relations of components shown in the figures. As such, when used in such context, these terms should be construed in accordance with the spatial orientation of the components as depicted in the relevant figures and not as absolute terms.

Figure 2:
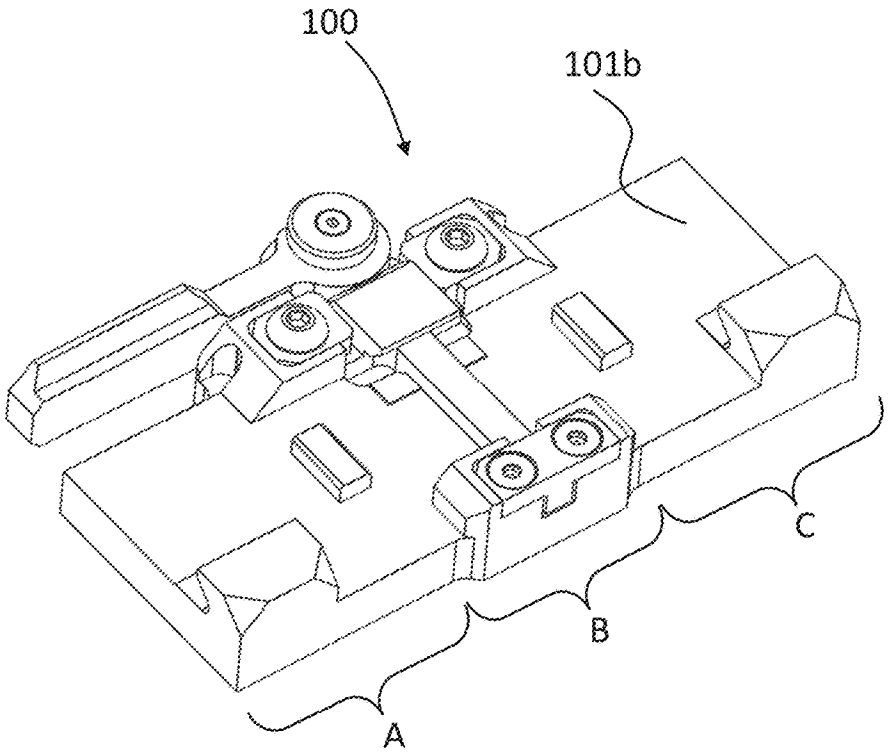
FIG. 2 is a bottom view of the same mount, according to an example embodiment of the present disclosure.

FIG. 1 is a top view of a kinematic rail mount for mounting a device on a firearm rail, and FIG. 2 is a bottom view of the same mount, according to an example embodiment of the present disclosure. The device, which is not shown, may, for example, be attached to a top surface 101*a* of the kinematic rail mount 100 (or just "mount" hereinafter for convenience), or a case for housing the device may be integrally formed with the mount 100.

Figure 3:
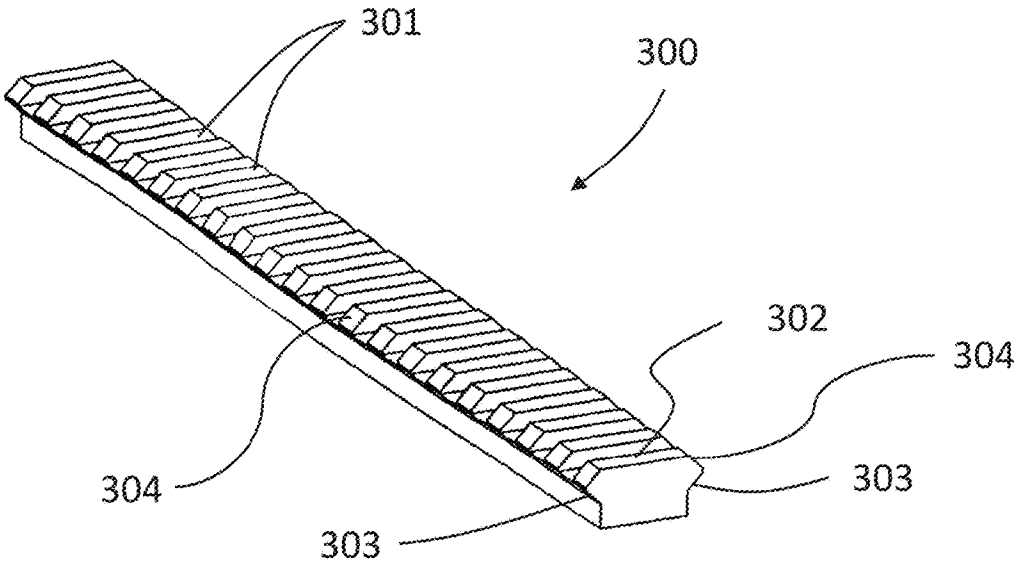
FIG. 3 shows an example of a firearm rail on which the mount may be mounted.
Figure 4:
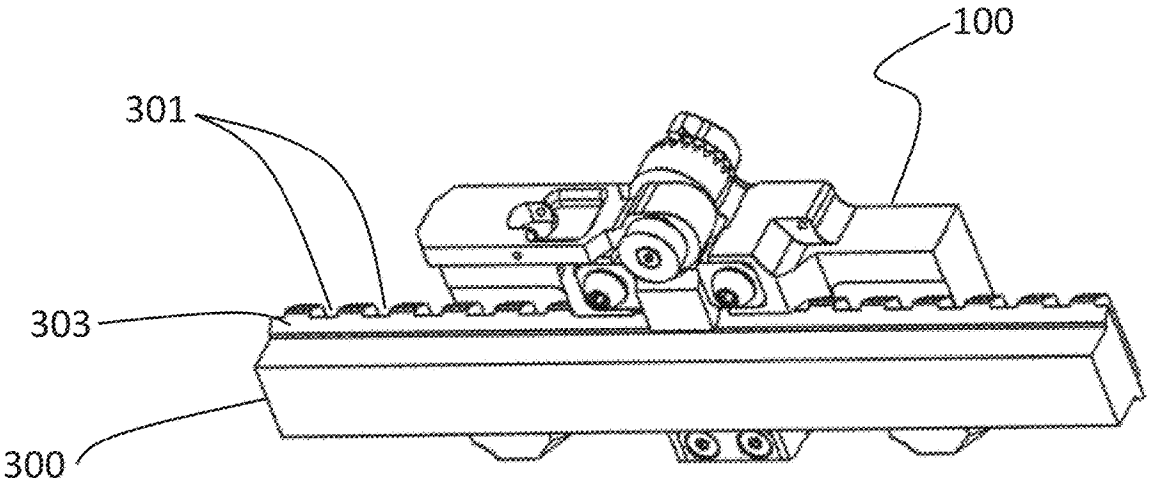
FIG. 4 shows an example of how the mount may be mounted onto the rail, according to an example embodiment.

FIG. 3 shows an example of a firearm rail on which the mount may be mounted, and FIG. 4 shows an example of how the mount may be mounted onto the rail, according to an example embodiment. The rail 300 shown in FIG. 3 is an example of a Picatinny rail (also known as MIL-STD-1913 rail) having a plurality of slots 301, a topmost surface 302 including angled edge portions 304, and an under surface 303 extending along opposing sides of the rail 300. In the illustrated embodiment, under surface 303 is angled with respect to the upper portion of topmost surface 302 and with respect to the angled edge portions 304 of topmost surface 302. The topmost surface 302, in this case, is discontinuously formed and interspersed by the slots 301 such that the topmost surface 302 includes a plurality of coplanar surfaces. As shown in FIG. 4 and discussed in further detail below, the mount 100 mounts to the rail 300 by way of a clamping mechanism that minimally contacts the topmost surface 302 and under surface 303 of the rail 300. In other variations mount 100 may be configured to mount to any other suitable firearm rail, such as for example a NATO rail.

Figure 5:
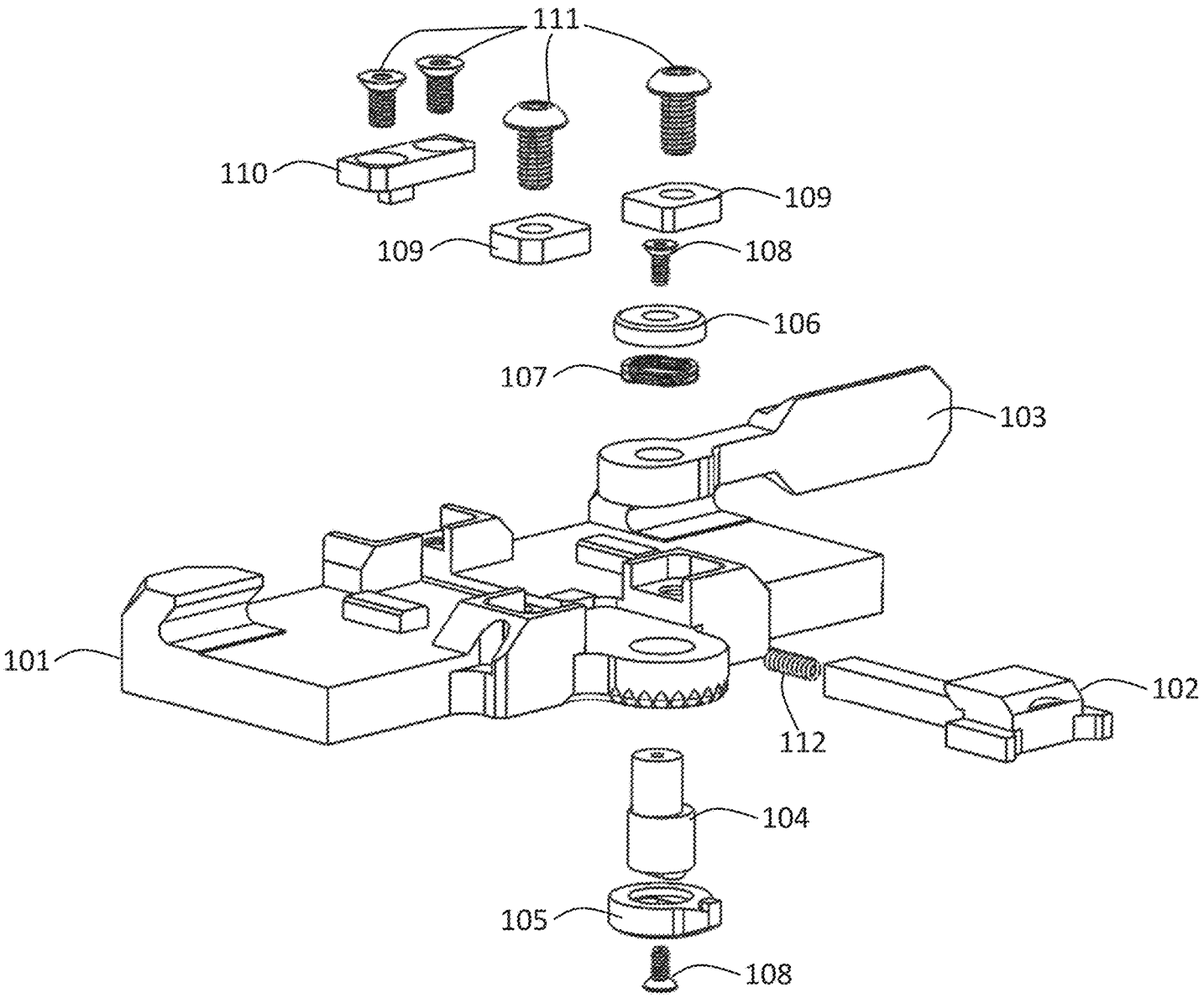
FIG. 5 shows an exploded, bottom view of the mount, according to an example embodiment.

FIG. 5 shows an exploded, bottom view of the mount, according to an example embodiment. The mount 100 includes a frame 101, a clamp 102, a lever cam 103, an adjustment cam 104, a knob 105, a release button 106, a release button spring 107, cam screws 108, guide brackets 109, an endplate bracket 110, bracket screws 111, and a clamp return spring 112. Although the embodiment of FIG. 5 shows many of the parts of the mount 100 as being separately formed and subsequently combined, one or more of the parts may be integrally formed. For example, instead of securing the brackets 109 and 110 using the bracket screws 101, the brackets 109 and 110 may be integrally formed with the frame 101, according to another embodiment. As another example, instead of securing the knob 105 to the adjustment cam 104 using one of the cam screws 108, the knob 105 may be integrally formed with the adjustment cam 104, according to another embodiment.

Figure 6:
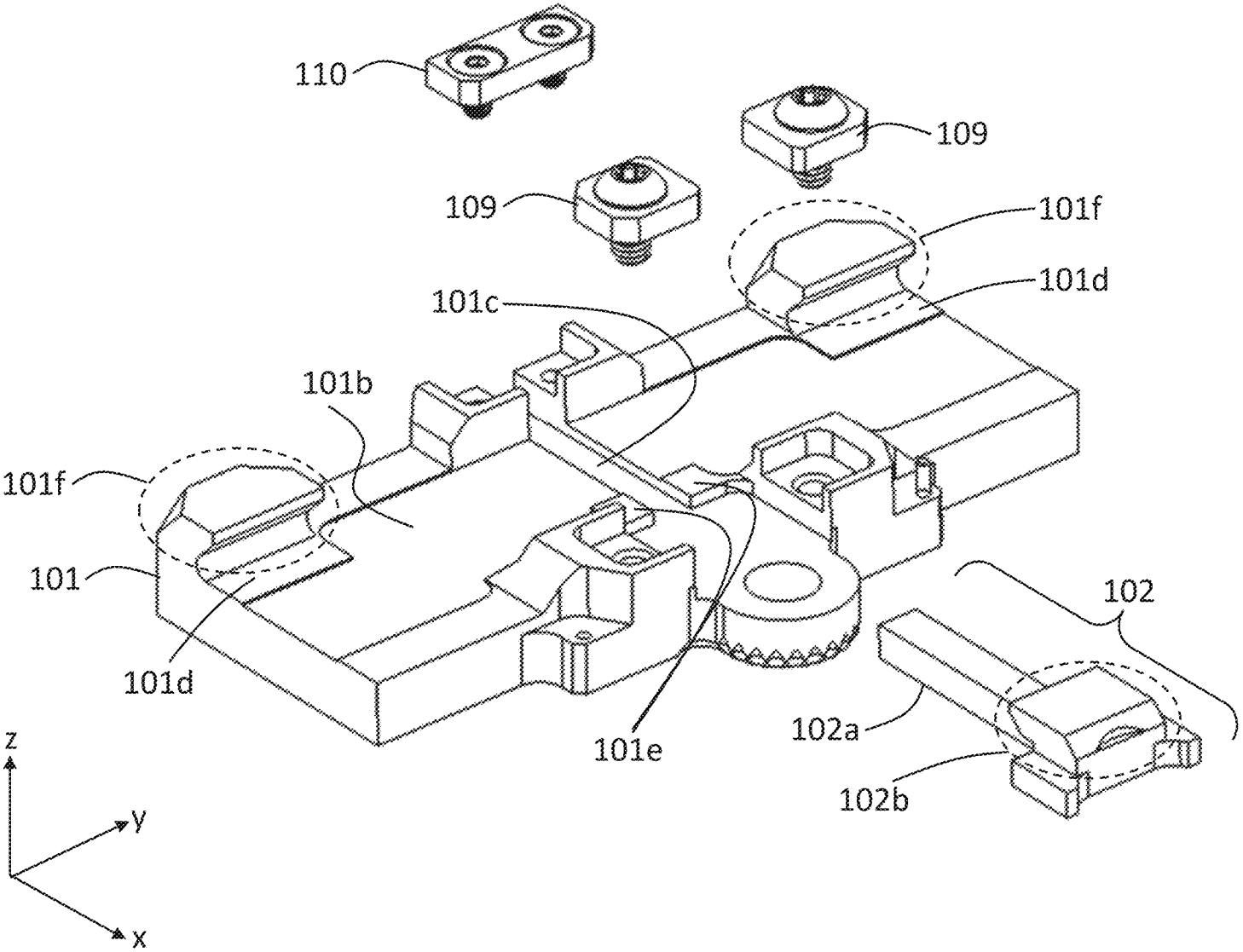
FIG. 6 shows a partial, exploded view of the mount detailing the frame and the clamp, according to an example embodiment.

FIG. 6 shows a partial, exploded view of the mount detailing the frame and the clamp, according to an example embodiment. The frame 101 has a length along a first direction y, a width along a second direction x, and a height along a third direction z. A channel 101*c* is formed in a bottom surface 101*b* of the frame and extends along the second direction x. Raised pads 101*d*, which are elevated along the third direction z with respect to the bottom surface 101*b*, are formed in opposite end portions A and C (see also FIG. 2) of the frame 101 along the first direction y. In particular, the raised pads 101*d* are disposed closer to a first edge of the frame 101 extending along the first direction y than to an opposing, second edge of the frame 101. A raised pad 101*e*, which is also elevated along the third direction z with respect to the bottom surface 101*b*, is formed in an intermediate portion B and disposed closer to the opposing, second edge of the frame 101. The raised pad 101*e* may be disposed on opposing sides of the channel 101*c*.

The frame 101 also includes hook-shaped members 101*f* formed in opposite end portions A and C (see also FIG. 2) of the frame 101 along the first direction y. In particular, the hook-shaped members 101*f* are disposed closer to the first edge of the frame 101 extending along the first direction y than to the opposing, second edge of the frame 101. More about the function and configuration of the raised pads 101*d* and 101*e* and hook-shaped members 101*f* is discussed later on below.

The clamp 102 includes a guide portion 102*a* that is configured to be slidable in the channel 101*c* of the frame 101 and a hook-shaped member 102*b* disposed closer to the second edge of the frame 101 than to the first edge of the frame 101. Motion of the clamp 102 along the third direction z is constrained with respect to the frame 101 by guide brackets 109, which are secured to the frame 101 by bracket screws 111. While the clamp 102 is slidable in the channel 101*c* along the second direction, its range of motion may be limited by the endplate bracket 110, which is also secured to the frame 101 by bracket screws 111. For example, the endplate bracket 110 may include an endplate that prevents the clamp guide 102*a* from sliding and extending beyond the first edge of the frame 101. The clamp return spring 112 may be disposed between the endplate and an end of the clamp guide 102*a* to provide a return spring force that pushes the clamp 102*a* towards the second edge of the frame 101. More about the function and configuration of the hook-shaped member 102*b* and clamp return spring 112 is discussed later on below.

Figure 7:
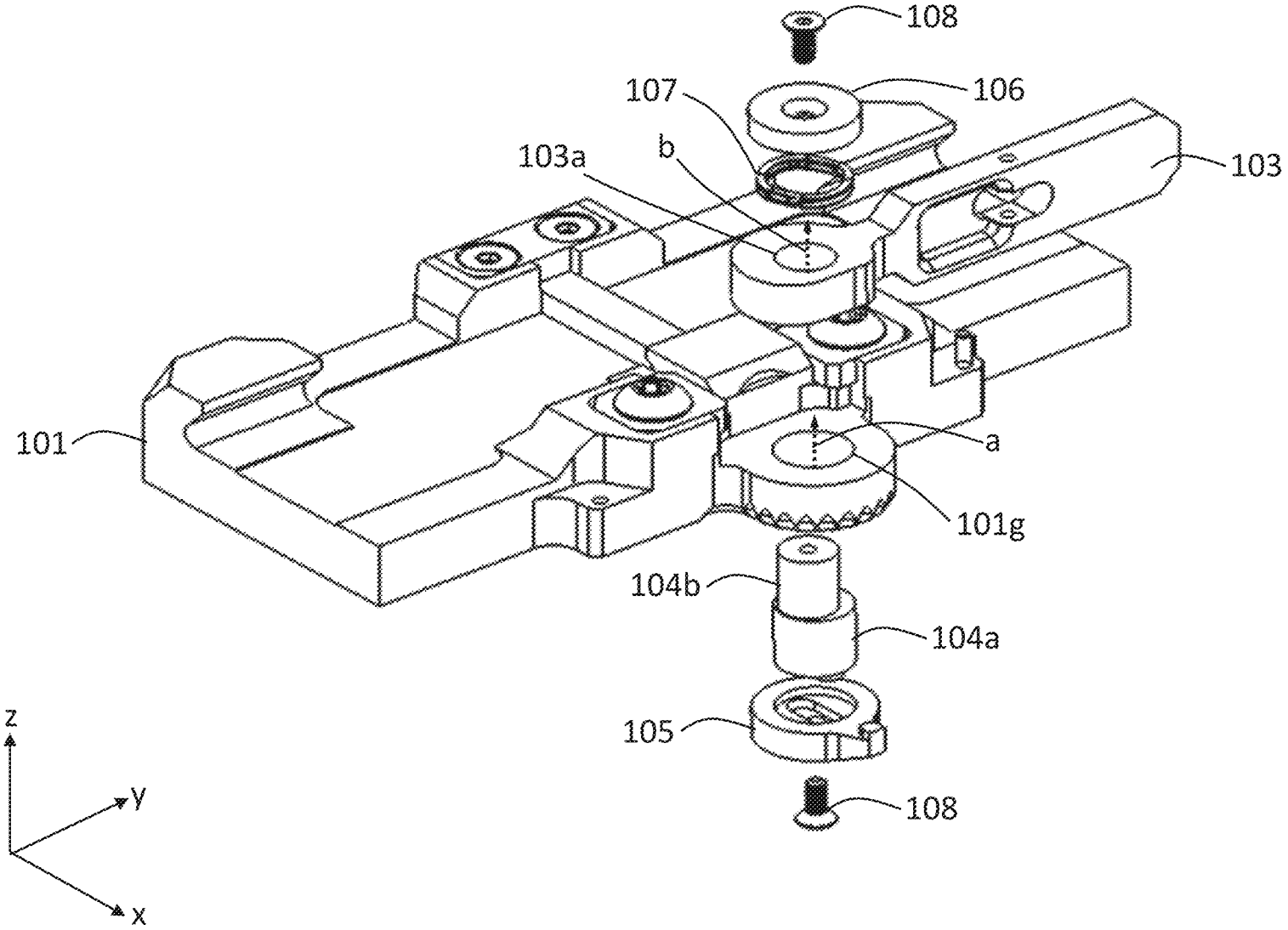
FIG. 7 shows a partial, exploded view of the mount detailing the cam mechanism, according to an example embodiment.
Figure 10:
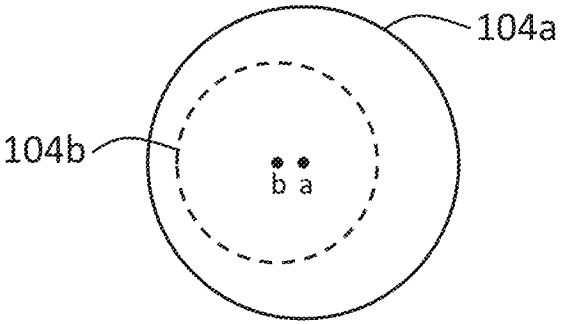
FIG. 10 shows another view of the adjustment cam taken along an axial direction, according to an example embodiment.
Figure 9:
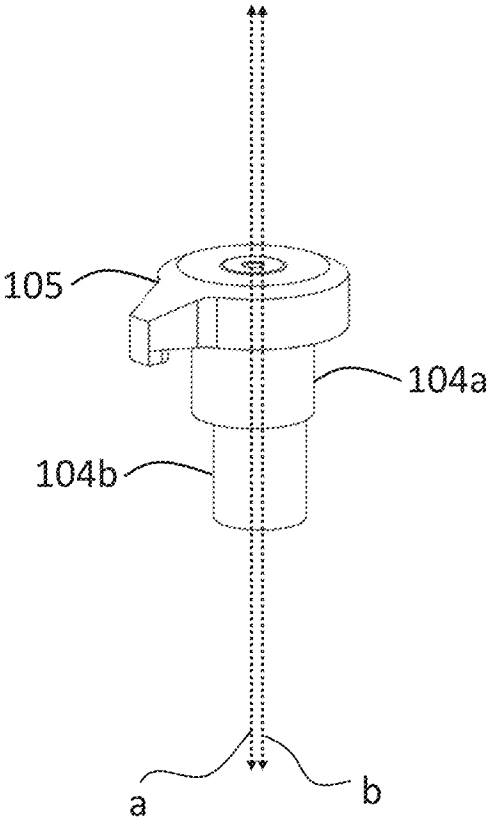
FIG. 9 shows an example structure of the adjustment cam and knob, according to an example embodiment.
Figure 8:
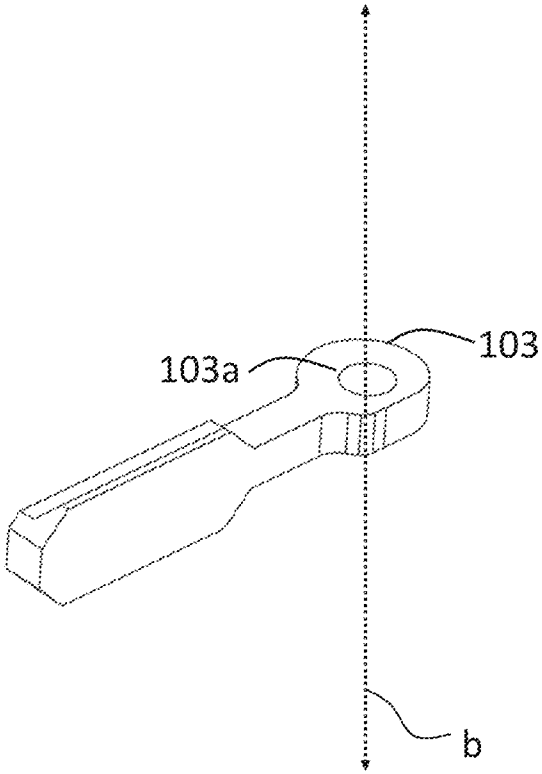
FIG. 8 shows an example structure of the lever cam, according to an example embodiment.

FIG. 7 shows a partial, exploded view of the mount detailing the cam mechanism, according to an example embodiment. FIG. 8 shows an example structure of the lever cam, and FIG. 9 shows an example structure of the adjustment cam and knob. FIG. 10 shows another view of the adjustment cam taken along the third direction z. The cam mechanism shown in FIG. 7 utilizes a cam-in-a-cam configuration that allows a user to fine-tune the maximum clamping force of the mount without the use of a tool, thereby overcoming an earlier-discussed drawback of existing mounts. The adjustment cam 104 is operatively connected to the frame 101 to be rotatable around a first axis a extending along the third direction z. The adjustment cam 104 is an eccentric cam and includes a first portion 104*a* and a second portion 104*b* that are non-concentric with each other. The first portion 104*a* of the adjustment cam 104 is inserted through and disposed within a first bore 101*g* formed in the frame 101. The first axis a passes through both a center of the first bore 101*g* and a center of the first portion 104*a* of the adjustment cam 104.

The lever cam 103 is operatively connected to the adjustment cam 104 to be rotatable around a second axis b extending along the third direction z. The second portion 104*b* of the adjustment cam 104 is inserted through and disposed within a second bore 103*a* formed in the lever cam 103. The second axis b passes through both a center of the second bore 103*a* and a center of the second portion 104*b* of the adjustment cam 104.

The adjustment cam 104, frame 101, and lever cam 103 are held together by the knob 105, which is operatively connected to the first portion 104*a* of the adjustment cam 104 via one of the cam screws 108, and by the release button 106, which is operatively connected to the second portion 104*b* of the adjustment cam 104 via another one of the cam screws 108. That is, the knob 105 and the release button 106 are disposed on opposite ends of the adjustment cam 104. The knob 105 is configured to rotate the adjustment cam 102 with respect to the frame 101 when the knob 105 is rotated. The release button spring 107 is disposed coaxially with the second portion 104*b* of the adjustment cam 104 between the release button 106 and the frame 101 to provide a spring force along the first and second axes a and b.

Figure 11:
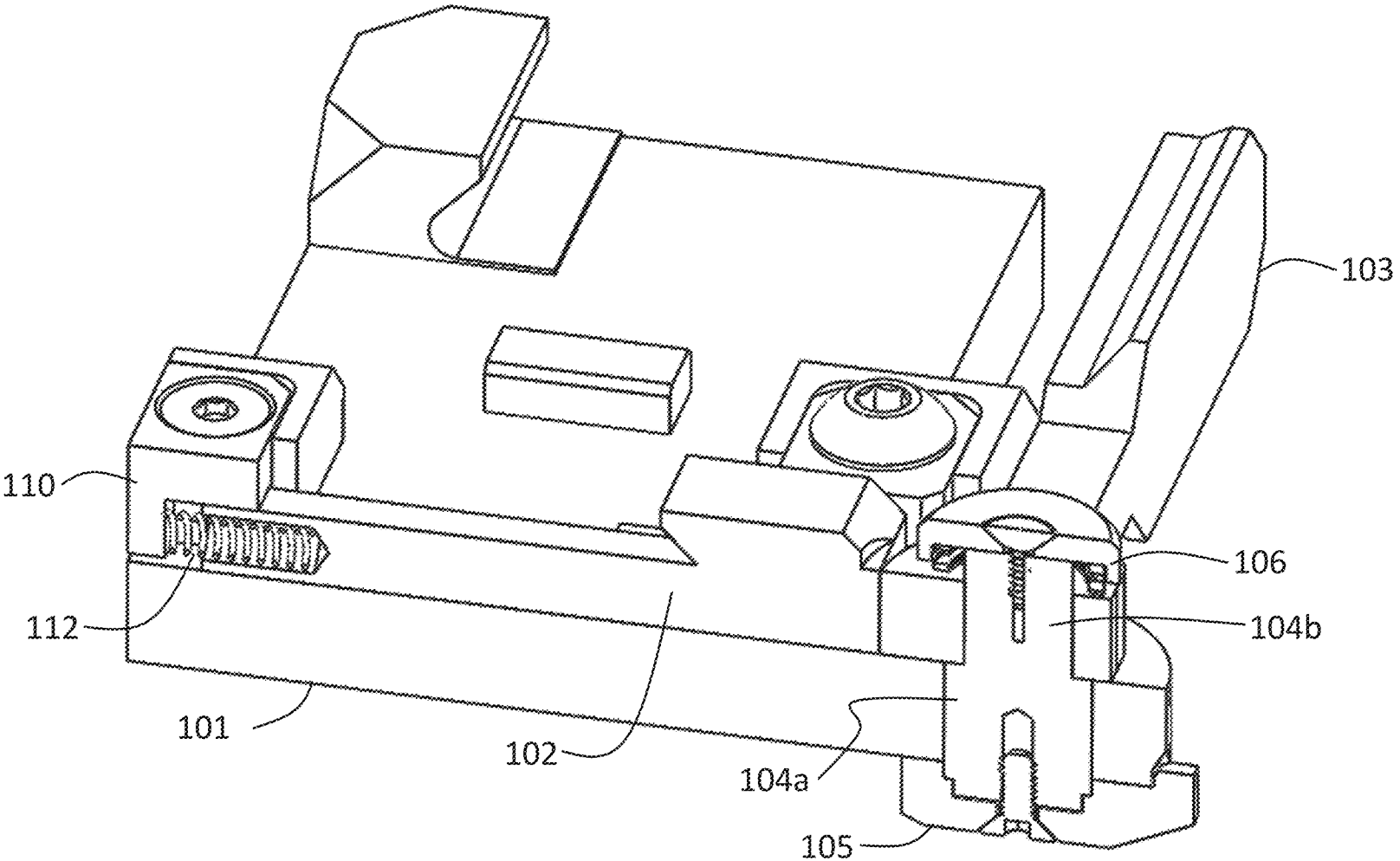
FIG. 11 shows a cross-sectional view of the mount when assembled, according to an example embodiment.

FIG. 11 shows a cross-sectional view of the mount when assembled, according to an example embodiment. In its assembled state, the clamp 102 acts as a cam follower to the lever cam 103. That is, when the lever cam 103 is rotated in one direction, it pushes the clamp 102 towards the first edge of the frame 101 along which the endplate bracket 110 is disposed. Thus, the lever cam 103 is configured to translate a rotary force applied thereto into a linear force applied to the clamp 102 along the second direction x. When the lever cam 103 is rotated in the other direction, it allows the clamp 102 to retract towards the second edge of the frame 101 via a spring force provided by the return spring 112.

Figure 12A:
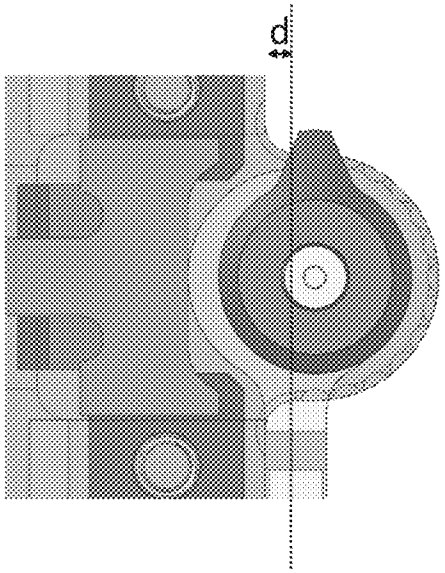
FIGS. 12*a*, 12*b* and 12*c* illustrate the distance of the lever cam with respect to the frame as the adjustment cam is rotated, according to an example embodiment.
Figure 12B:
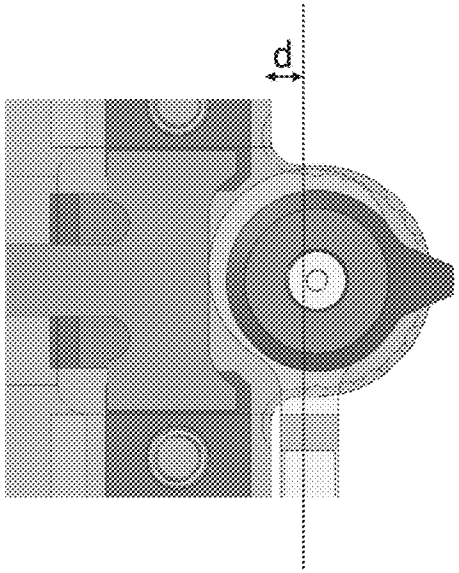
Figure 12C:
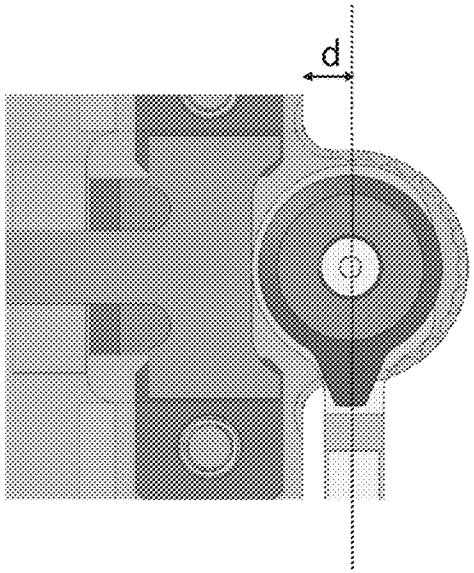

FIGS. 12*a*, 12*b* and 12*c* illustrate the distance of the lever cam with respect to the frame as the adjustment cam is rotated, according to an example embodiment. As the adjustment cam 104 is rotated through its rotational range (e.g., 180 degrees), which is indicated by the angular position of the knob 105, the distance d between the frame 101 and the axis of rotation of the lever cam 103 is changed. This is because the lever cam 103 rotates around the second axis b, which passes through the center of the second portion 104*b* of the adjustment cam 104, and the second portion 104*b* of the adjustment cam 104 is non-concentric with the first portion 104*a* of the adjustment cam 104. Thus, when the first portion 104*a* of the adjustment cam 104 is rotated around the first axis a by the use of the knob 105, the position of the second axis b is shifted closer to or further from the frame 101 along the second direction x. Shifting the second axis b, and thereby the lever cam 103, closer to the frame 101 increases the maximum clamping force that can be applied against the rail, and vice versa. Accordingly, the cam-in-a-cam mechanism of the presently disclosed mount allows a user to fine-tune the maximum clamping force of the mount by adjusting the angular position of the knob 105 without the use of a tool, thereby overcoming an earlier-discussed drawback of existing mounts.

Figure 13:
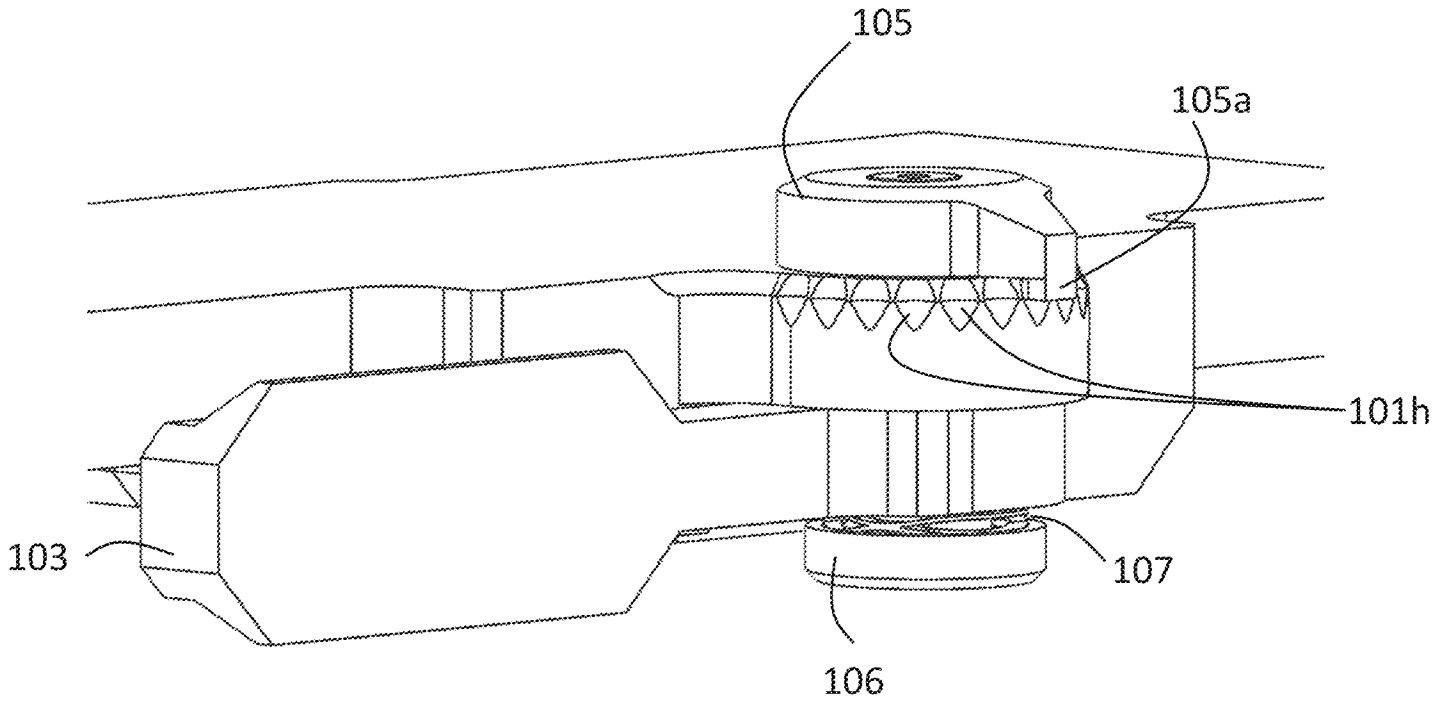
FIG. 13 shows an example locking mechanism that prevents the knob from being unintentionally rotated, according to an embodiment.

FIG. 13 shows an example locking mechanism that prevents the knob from being unintentionally rotated, according to an embodiment. The locking mechanism of FIG. 13 utilizes a plurality of regularly-spaced grooves 101*h* formed in the frame 101, for example, along a perimeter where the knob 105 is disposed. The knob 105 includes a protrusion 105*a* and is configured to maintain the angular position of the adjustment cam 104 with respect to the frame 101 by interlocking the protrusion 105*a* with one or more of the plurality of regularly-spaced grooves 101*h* in the frame 101. An interlocking force that keeps the protrusion 105*a* engaged or interlocked with the one or more regularly-spaced grooves 101*h* is provided by the release button spring 107 disposed between the release button 106 and the frame 101. While the release button 106 is pressed, thereby compressing the release button spring 107, the interlock between the protrusion 105*a* and the one or more regularly-formed grooves 101*h* is disengaged and the adjustment cam 104 may be rotated by rotating the knob 105. After the angular position of the knob 105 has been changed, the interlock may be reengaged by releasing the release button 106. Because the protrusion 105*a* interlocks with one or more of the grooves 101*h*, the angular position of the knob is set only in increments determined by the spacing of the grooves.

Figure 14:
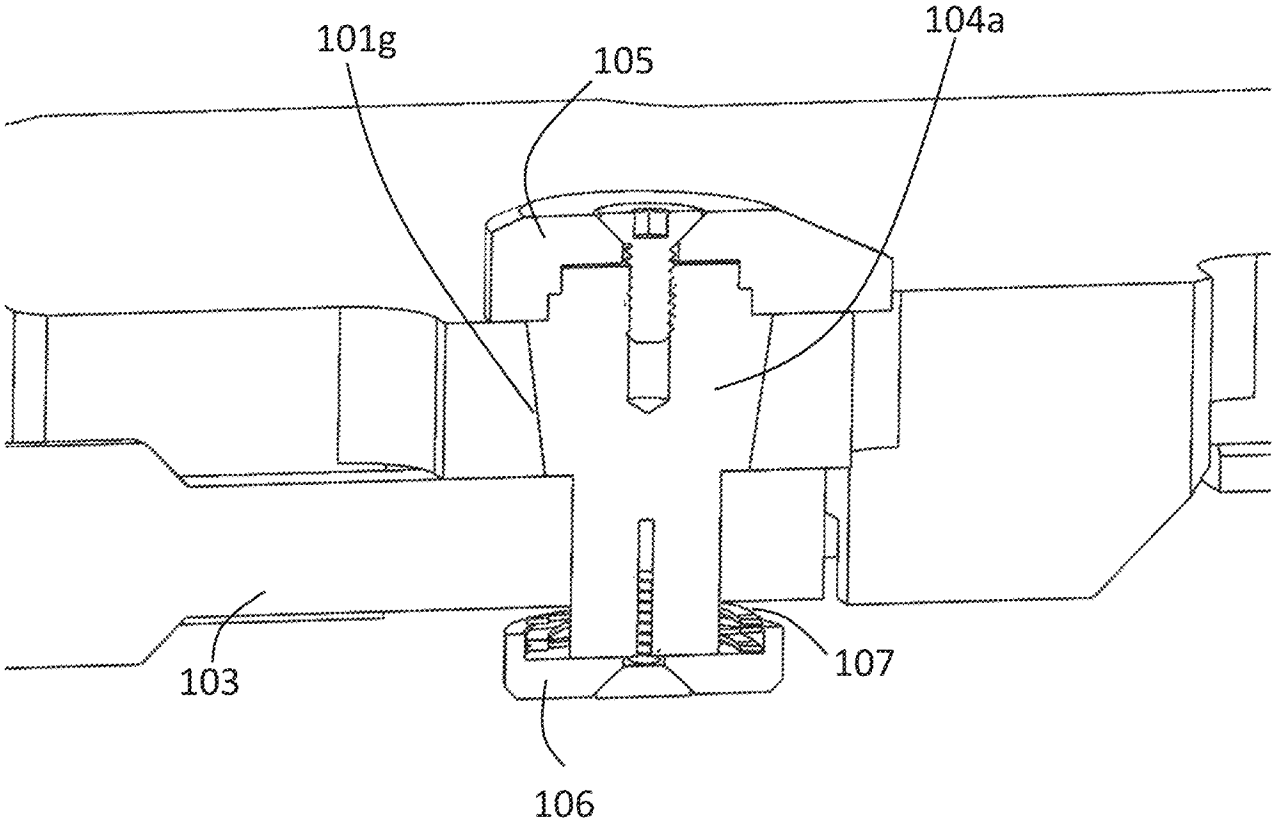
FIG. 14 shows another example locking mechanism that prevents the knob from being unintentionally rotated, according to an embodiment.

FIG. 14 shows another example locking mechanism that prevents the knob from being unintentionally rotated, according to an embodiment. According to this embodiment, the first portion 104*a* of the adjustment cam 104 has a male taper profile, and the first bore 101*g* of the frame 101 has a corresponding female taper profile for mating with the first portion 104*a* of the adjustment cam 104. A frictional interface between the tapered first portion 104*a* and the tapered first bore 101*g* is provided by the release button spring 107 disposed between the release button 106 and the frame 101. While the release button 106 is pressed, thereby compressing the release button spring 107, the frictional interface is disengaged and the adjustment cam 104 may be rotated by rotating the knob 105. The locking mechanism of FIG. 14 utilizes friction between two tapered profile surfaces to maintain the angular position of the knob 105 with respect to the frame 101, rather than the interlock shown in FIG. 13. Therefore, in the embodiment of FIG. 14, the angular position of the knob 105 can be adjusted in any increment.

In the variations shown in FIG. 13 and FIG. 14, the locking mechanism relies on an interlocking force that is directed axially along the adjustment cam 104 to engage protrusions 105*a* in grooves 101*h* (FIG. 13) or to engage tapered adjustment cam portion 104*a* in tapered first bore 101*g* of frame 101 (FIG. 14). In contrast, in the variation shown in FIG. 15 and FIG. 16, the locking mechanism relies on an interlocking force that is directed laterally (e.g., perpendicularly) against the adjustment cam to secure the adjustment cam in a selected orientation.

Figure 15:
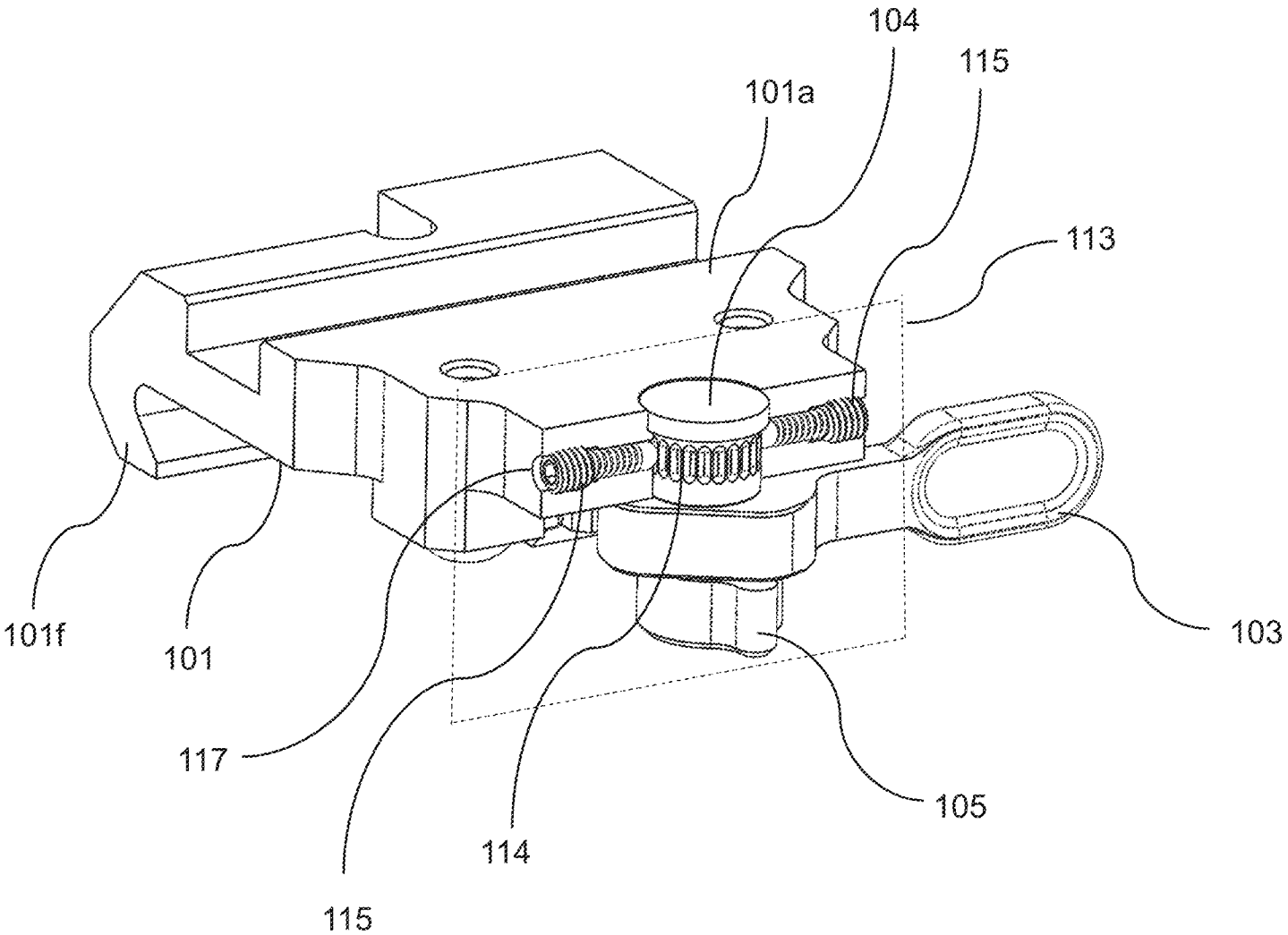
FIGS. 15 and 16 show another example locking mechanism that prevents the knob from being unintentionally rotated, according to an embodiment.

In the side perspective view shown in FIG. 15, a portion of frame 101 is removed at cut plane 113 (oriented perpendicularly to surface 101*a* of frame 101) to expose a locking mechanism comprising adjustment cam 104 and laterally oriented spring pins 115. In the upper perspective view shown in FIG. 16, portions of frame 101, adjustment cam 104, and spring pins 115 are removed at cut plane 118 (oriented parallel to surface 101*a* of frame 101) to provide a cross-sectional view of the locking mechanism.

Figure 16:
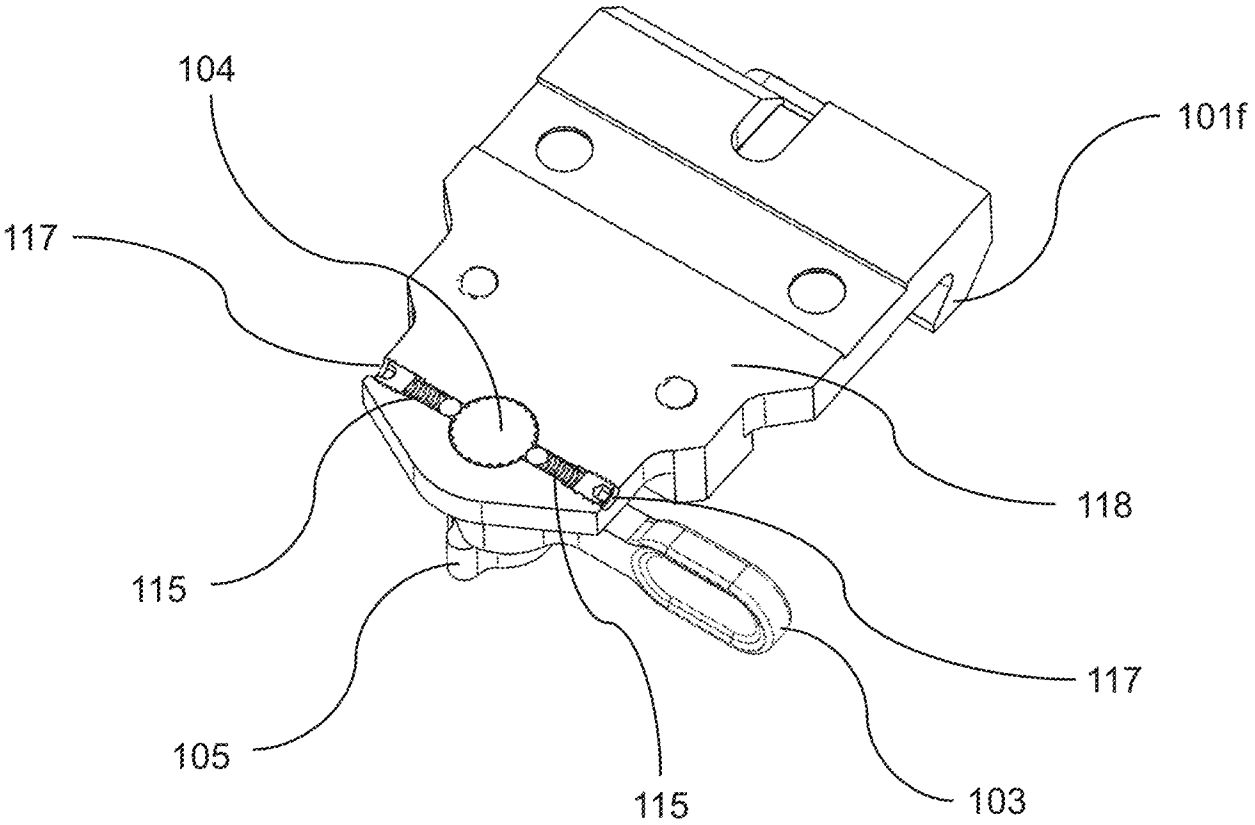

In the variation illustrated in FIG. 15 and FIG. 16, adjustment cam 104 has the form of a king pin cam comprising radial tapered detents (ramps) 114. One or more spring pins 115 are arranged in (optionally threaded) holes 117 so that their inner ends engage detents 114 on adjustment cam 104 to exert a lateral force that prevents adjustment cam 104 from rotating freely. (The inner end of a spring pin may be or comprise a pin or a ball, for example). Adjustment cam 104 may be rotated about its long axis as described below but, in contrast to the variations of FIG. 13 and FIG. 14, it does not translate along its long axis.

The interlocking lateral forces exerted by the spring pins on the tapered detents on adjustment cam 104 may be overcome by exerting a sufficient rotational force on knob 105, which in this case functions as a lever on the king pin, to rotate the adjustment cam to a new position at which the spring pins will again engage detents 114 to retain the adjustment cam in its new radial orientation. As the rotational force is exerted on knob 105, the spring pins ride up the ramped walls of the tapered detents and then descend the tapered walls of adjacent detents.

Alternatively, detents 114 may be square edged locking detents and pins 115 may be spring-loaded locking pins. In such variations the spring-loaded locking pins may be retracted to disengage their ends from the detents to allow rotation of adjustment cam 104 to a new detent position.

Although the illustrated variation shows the use of two oppositely positioned pins 115, other variations may use only one pin or more than two pins, and the pins may be laterally arranged around adjustment cam 104 in any suitable manner.

As discussed earlier, another drawback of existing mounts is that, when mounting a sight, they may not always return the sight to zero due to their over constraining clamping mechanism. Existing mounts are generally designed to clamp against the surfaces of the rail using long, thin surfaces. However, due to inherent manufacturing tolerances, these long, thin surfaces of the mount, as well as the surfaces of the rail, are often not exactly flat, parallel, or angled to specification. These imperfections prevent the parts from fitting together exactly and may cause damage to the rail resulting in burrs and dings. For example, when these imperfect long, thin surfaces of the mount are clamped against the surfaces of the rail, an excessive number of contact points may be generated, resulting in an over constrained system. This means that the resting position between the mount and clamped rail becomes non-deterministic and elastically averaged. Thus, each time the mount is un-mounted and re-mounted, the resting position of the mount may slightly differ.

Figure 18:
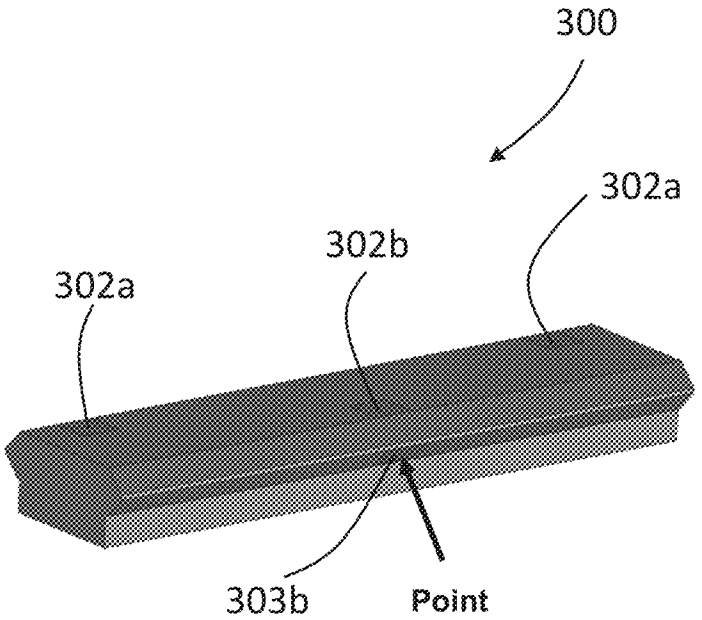
FIGS. 17 and 18 show example contact points on the rail at which the mount makes contact, according to an embodiment.
Figure 17:
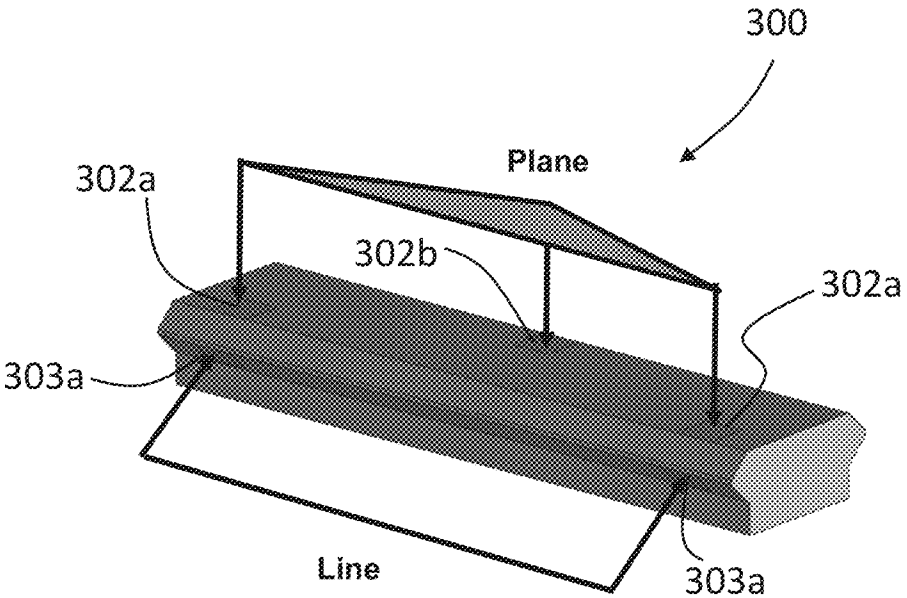
Figure 19:
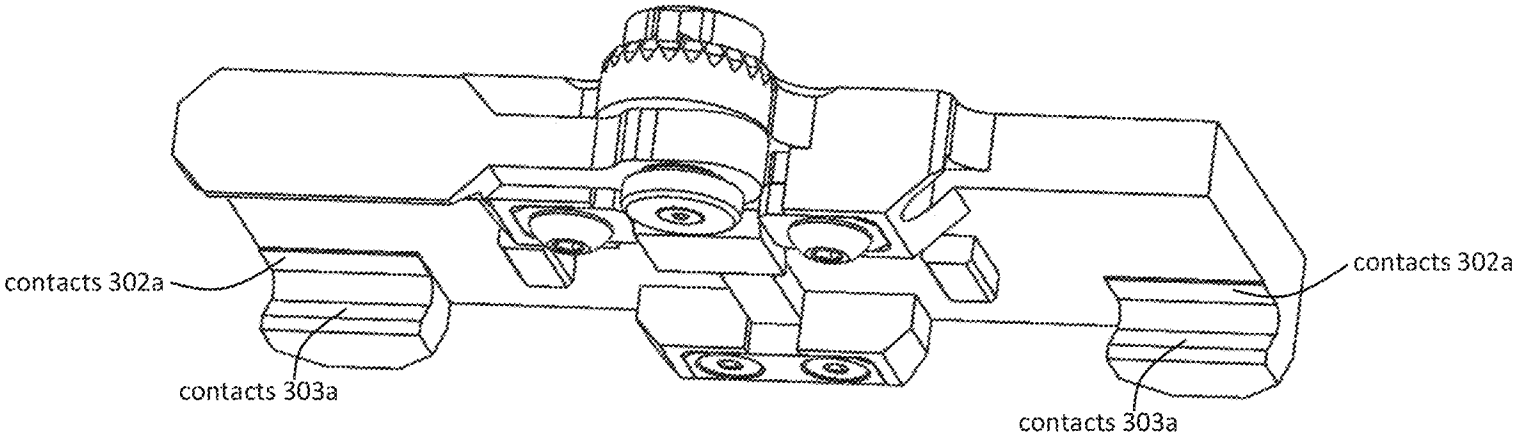
FIGS. 19 and 20 show example contact points on the mount that correspond to the contact points on the rail shown in FIGS. 17 and 18, according to an example embodiment.
Figure 20:
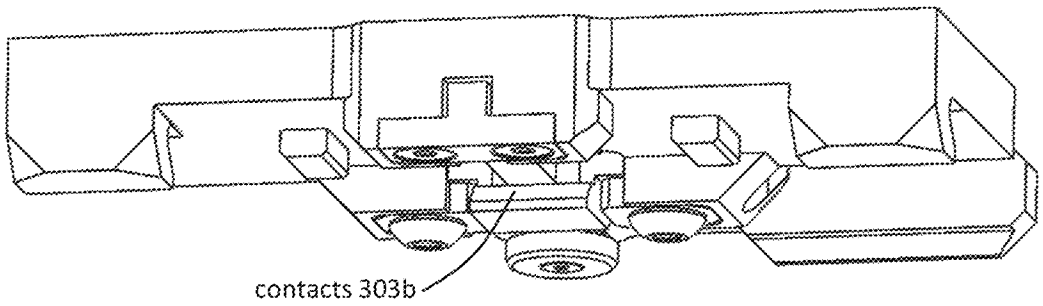

In contrast, the mount according to embodiments of the present disclosure provides a deterministic, or significantly more deterministic, resting position between the mount and rail by minimizing the number of intentional and unintentional contact points between the mount and the rail, thereby approaching that of a true kinematic rail mounting system. FIGS. 17 and 18 show example contact points on the rail at which the mount makes contact, according to an embodiment. FIGS. 19 and 20 show example contact points on the mount that correspond to the contact points on the rail, according to an example embodiment. The first set of contact areas 302*a* and 302*b* on the upper portion of topmost surface 302 of the rail 300 forms a stable triangle platform (i.e., determines a primary plane) at the furthest extents of the mount, thereby restraining the system (e.g., mount+rail) in 3 degrees of freedom (DOF). According to this embodiment, the frame 101 only contacts the topmost surface of the rail 300 by only the raised pads 101*d* and 101*e* (refer back to FIG. 6). In particular, the contact areas 302*a* are contacted by the raised pads 101*d* of the frame 101, and the contact area 302*b* is contacted by the raised pad 101*e* of the frame 101. Surfaces of the raised pads 101*d* and 101*e* contacting the topmost surface 302 of the rail 300 are formed to be discontinuous with each other to minimize the size of the contact areas with the rail. These small contact areas provide a more deterministic restraining solution approaching that of a perfectly constrained system.

A second set of contact areas 303*a* on the under surface 302 along one side of the rail 300 constrains the system in two more DOF (i.e., determines a line). The contact areas 303*a* are disposed adjacent to the contact areas 302*a* to face each other so as to reduce the degrees of freedom in the system. According to this embodiment, the frame 101 contacts the under surface along the one side of the rail 300 by only the hook-shaped members 101*f* (refer back to FIG. 6). Surfaces of the hooked-shaped members 101*f* contacting the under surface of the rail are formed to be discontinuous with each other, rather than forming one long continuous surface, to minimize the size of the contact areas with the rail. Again, these small contact areas provide a more deterministic restraining solution approaching that of a perfectly constrained system.

A last contact area 303*b* on the under surface 302 along an opposing side of the rail 300 constrains the system in another DOF (i.e., determines a point). The contact area 303*b* is disposed adjacent to the contact area 302*b* to face each other so as to reduce the amount of flex in the system, that is, to increase the stiffness of the system. According to this embodiment, the mount contacts the under surface along the opposing side of the rail 300 by only the hook-shaped member 102*b* (refer back to FIG. 6) of the clamp 102. When actuated by the lever cam 103, the clamp 102 forces the rail 300 up against the other 5 contact areas and by friction, constrains the mount to the rail 300, thereby removing the last DOF.

Referring again to FIG. 6, according to another embodiment raised pads 101*d* and 101*e*, hook shaped members 101*f*, and/or hooked shaped member 102*b* of clamp 102 comprise curved (e.g., large radius spherical) surfaces where they make contact with the rail. Some, all, or any combination of these features may comprise such curved surfaces. This way, the curved (e.g., spherical) contact area (or patch) between the flat surface (rail) and the curved surface (mount) becomes smaller. As the contact patch becomes smaller, the system approaches that of a true kinematic mounting system (e.g., point contact on a flat surface). Also, the contact patch (spherical surface) may be sized (radius) to limit the Hertzian stresses in the material.

Figure 21:
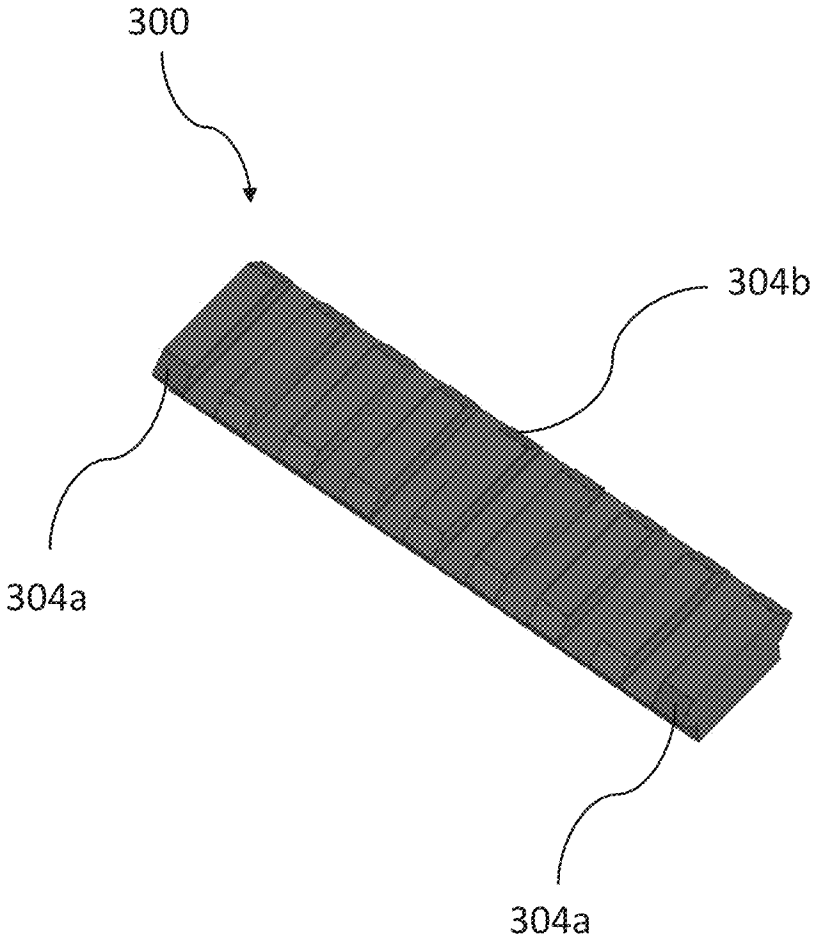
FIG. 21 shows an alternative set of contact points on the rail at which the mount may make contact, according to another embodiment.

Referring now to FIG. 21, in another embodiment the mount may be configured to make contact with the topmost surface of the rail at three points 304*a* and 304*b* located on angled edge portions 304 of topmost surface 302. The set of contact areas 304*a* and 304*b* forms a stable triangle platform (i.e., determines a primary plane) at the furthest extents of the mount, thereby restraining the system (e.g., mount+rail) in 3 degrees of freedom (DOF) similarly to the set of contact areas 303*a* and 303*b* shown in FIGS. 17 and 18.

In summary, the mount according to example embodiments disclosed herein provides at least two advantages over existing mounts. First, the presently disclosed mount includes a cam-in-a-cam clamping mechanism that allows a user to fine-tune the maximum clamping force of the mount without the use of a tool. Second, the presently disclosed mount provides a deterministic, or significantly more deterministic, resting position between the mount and rail by minimizing the number of intentional and unintentional contact points between the mount and the rail, thereby approaching that of a true kinematic mounting system that is significantly better suited for mounting a sight on a firearm.

The various features of the representative examples and the dependent claims may be combined in ways that are not specifically and explicitly enumerated in order to provide additional embodiments of the present teachings. The dimensions and the shapes of the components shown in the figures are designed to help understand how the present teachings are practiced and do not limit the dimensions and the shapes shown in the examples.

What is claimed is:

1. A rail mount for mounting a device on a rail, the mount comprising:

a frame having a length along a first direction, a width along a second direction, and a height along a third direction;

a clamp operatively connected to the frame to be slidable with respect to the frame along the second direction to clamp the mount to the rail;

an adjustment cam operatively connected to the frame to be rotatable around a first axis extending along the third direction; and a lever cam operatively connected to the adjustment cam to be rotatable around a second axis extending along the third direction, wherein the lever cam is configured to translate a rotary force applied thereto into a linear force applied to the clamp along the second direction, and wherein the adjustment cam is configured to shift the second axis closer to or further from the frame along the second direction when the adjustment cam is rotated around the first axis.

2. The rail mount of claim 1, wherein:

the frame has a first end portion and a second end portion arranged along the first direction and an intermediate portion disposed between the first and second end portions, and the clamp includes a guide disposed in a channel formed in the intermediate portion of the frame.

3. The rail mount of claim 1, wherein the clamp is configured as a cam follower to the lever cam such that:

rotation of the lever cam in one direction pushes the clamp towards a first edge of the frame, and rotation of the lever cam in an opposite direction allows the clamp to retract towards a second edge of the frame, the first and second edges being opposing edges extending along the first direction.

4. The rail mount of claim 3, wherein a retraction force of the clamp is provided by a return spring connected to the clamp.

5. The rail mount of claim 1, wherein:

the adjustment cam is an eccentric cam having a first portion and a second portion that are non-concentric with each other, the frame includes a first bore, the lever cam includes a second bore, the first portion of the adjustment cam is inserted through the first bore, the second portion of the adjustment cam is inserted through the second bore, the first axis passes through both a center of the first bore and a center of the first portion of the adjustment cam, and the second axis passes through both a center of the second bore and a center of the second portion of the adjustment cam.

6. The rail mount of claim 5, further comprising a knob operatively connected to the adjustment cam and configured to rotate the adjustment cam with respect to the frame when the knob is rotated.

7. The rail mount of claim 6, wherein the knob is integrally formed with the adjustment cam.

8. The rail mount of claim 6, wherein the knob includes a protrusion and is configured to maintain the angular position of the adjustment cam with respect to the frame by interlocking the protrusion with one or more of a plurality of regularly-spaced grooves in the frame.

9. The rail mount of claim 8, further comprising:

a release button operatively connected to the adjustment cam, and a compression spring configured to provide an interlocking force that maintains interlock between the protrusion and the one or more regularly-spaced grooves, wherein the release button is configured to disengage the interlock between the protrusion and the one or more regularly-spaced grooves while the release button is pressed.

10. The rail mount of claim 9, wherein:

the knob and the release button are disposed on opposite ends of the adjustment cam, and the compression spring is disposed coaxially with the second portion of the adjustment cam between the release button and the frame to provide the interlocking force.

11. The rail mount of claim 6, wherein:

the first portion of the adjustment cam has a male taper profile, and the first bore of the frame has a corresponding female taper profile for mating with the first portion of the adjustment cam.

12. The rail mount of claim 11, further comprising:

a release button operatively connected to the adjustment cam, and a compression spring configured to maintain a frictional interface between the male and female taper profiles, wherein the release button is configured to disengage the frictional interface between the male and female taper profiles while the release button is pressed.

13. The rail mount of claim 12, wherein:

the knob and the release button are disposed on opposite ends of the adjustment cam, and the compression spring is disposed coaxially with the second portion of the adjustment cam between the release button and the frame to maintain the frictional interface between the male and female taper profiles.

14. The rail mount of claim 6 wherein the adjustment cam comprises radially arranged detents, comprising one or more pins or balls arranged to engage the detents and exert a lateral force on the adjustment cam to maintain the angular position of the adjustment cam with respect to the frame.

15. The rail mount of claim 14, wherein the one or more pins or balls are spring pins or components of spring pins, the detents have a tapered profile, and rotation of the knob overcomes the lateral forces exerted by the one or more spring-pins on the adjustment cam to rotate the adjustment cam to a different angular position and shift the one or more spring-pins into different detents.

16. The rail mount of claim 14, wherein the one or more pins are or one or more spring-loaded locking pins, the detents have a square profile, and the one or more spring-loaded locking pins must be retracted from the detents before the knob is rotated to rotate the adjustment cam to a different angular position.

* * * * *